US006601362B1

(12) United States Patent
Prince

(10) Patent No.: US 6,601,362 B1
(45) Date of Patent: Aug. 5, 2003

(54) VARIABLE LOAD CAPACITY CONSTRUCTION COMPONENTS FOR PATIO POOL ENCLOSURES

(76) Inventor: Richard T. Prince, 11211 84th Court N., West Palm Beach, FL (US) 33412

( * ) Notice: Subject to any disclaimer, the term of this patent is extended or adjusted under 35 U.S.C. 154(b) by 8 days.

(21) Appl. No.: 09/949,822

(22) Filed: Sep. 12, 2001

(51) Int. Cl.[7] ..... E04C 3/30

(52) U.S. Cl. ..... 52/732.1; 52/730.4; 52/737.1; 52/737.6

(58) Field of Search ..... 52/222, 273, 730.1, 52/730.3, 730.4, 731.2, 732.1, 737.1, 737.3, 737.4, 737.6, DIG. 8

(56) References Cited

U.S. PATENT DOCUMENTS 3,222,841 A * 12/1965 Lipof ..... 52/731.5
3,256,671 A * 6/1966 Handley ..... 52/731.2
3,382,639 A * 5/1968 Smith et al. ..... 52/731.3
3,413,775 A 12/1968 Katz
3,416,282 A 12/1968 Daugherty
3,745,734 A 7/1973 Davey et al.
3,789,563 A * 2/1974 Toti ..... 52/731.2
3,999,354 A * 12/1976 Anter et al. ..... 52/731.3
4,843,783 A 7/1989 Taravella
4,987,717 A * 1/1991 Dameron, Jr. ..... 52/732.1
5,031,083 A * 7/1991 Claesson ..... 362/249
5,088,252 A 2/1992 Antekeier
5,203,130 A 4/1993 Freelove
5,737,878 A 4/1998 Raulerson et al.
5,775,045 A 7/1998 Hill
5,802,800 A * 9/1998 Meyers ..... 52/731.2
5,904,022 A 5/1999 Zadok
5,910,084 A * 6/1999 Koike et al. ..... 52/204.1
6,385,941 B1 * 5/2002 Power et al. ..... 52/731.3

* cited by examiner

*Primary Examiner*—Carl D. Friedman
*Assistant Examiner*—Brian E. Glessner
(74) *Attorney, Agent, or Firm*—C. J. Husar, Esq.

(57) ABSTRACT

The disclosure relates to a novel beam and post/column construction which allows for a variety of decorative trim strips to be installed into grooves which are integrally formed in the outer surfaces of the beams and columns. Additionally, there is provision for selectively increasing the structural load capacity of the beam and column by insertion of one or more strengthening members into grooves located in the inner hollow portions thereof. The disclosure finds particular use in the construction of screened patio and pool enclosures. However, there are many other construction applications where the variable load capacity feature may be advantageously utilized to reduce the inventory normally required by a jobber.

9 Claims, 5 Drawing Sheets

VARIABLE LOAD CAPACITY CONSTRUCTION COMPONENTS FOR PATIO POOL ENCLOSURES

BACKGROUND OF THE INVENTION

The present invention relates to construction components such as beams and posts/columns. More specifically, it relates to beams and posts/columns which have a variable load capacity. The invention finds particular use in the construction of screened porch and patio/pool enclosures to form the frame work for the subsequently added screening. As one can imagine, a variety of beam and post/column capacities are required depending on the size of the particular job.

The popularity of all weather, almost invisible fiberglass screened porch and patio enclosures has been rapidly increasing throughout the country, especially in the south, southeast, southwest and lower west coastal areas of the country. These enclosures find their popularity in the fact that they are very effective in keeping insects out while allowing the sunlight and breezes in, which is conducive to eating or partying outdoors in peace, protected from flies, mosquitoes and other insects.

Furthermore, these enclosures prevent the accumulation of leaves and debris, thus reducing maintenance time and cost, create a safe play area for children and provide security from unauthorized entry to your patio/pool area by unsupervised children. In addition, they enhance the value of your property by providing more useful living space at a fraction of the cost of a room addition.

As one would expect, these enclosures come in a wide variety of sizes. Some enclose only porch areas, others pool and patio areas, while still others are sufficiently large to enclose the immediate exterior of a multi-level home with a balcony and also the patio and pool below. The construction of these enclosures utilize primary components, such as beams and posts/columns and secondary components such as purlins and other profiles which serve to brace and stabilize the beams and posts/columns when connected to each other. The purlins and profiles are commercially available in solid and hollow extruded forms. Conventional connectors, such as gusset plates, stud anchors, lags and self-tapping sheet metal screws are utilized in constructing an enclosure. The subject invention is concerned primarily with the construction of the beams and posts/columns which are the primary structural members which carry the live loads of the enclosure.

The enclosures are pre-measured, laid out, engineered and prefabricated in a shop in most instances. The wall panels are also pre-screened, however, the roof panels are screened on site. The entire pre-fabricated job is then assembled and erected and in most cases attached to the house structure.

As the projection from the fascia of the home to the back of the enclosure or patio area increases, so must the size of the beams and the uprights (posts/columns), depending on the height and span in order to carry the loads. By means of the present invention, applicant has developed a variable load system which can be used to incrementally increase the load carrying capacity of the beams and posts/columns depending on the design criteria of the job. Each of these components, i.e. the beam and post/column is comprised of a pair of U-shaped extruded aluminum members which are combined and secured to each other to form a hollow beam or post/column. These components have an inherent load capacity based upon the height, width and wall thickness of these members. The current way of increasing the structural strength of the load carrying beams and post/columns is to increase the overall dimensions of the beams and post/columns, resulting in a larger beam and posts/column. However, applicant has developed a unique U-shaped extruded profile which allows one to add additional material in the form of metallic inserts which increase the overall load carrying capacity of the beam or post/column while retaining the outside dimensions of the previously used beams and posts/columns. The newly designed members include provision for receiving metallic inserts in the interior wall portions of the U-shaped members for increasing their structural strength. The number of additional inserts can vary in number from one to four, depending upon the desired load carrying capacity requirements of the beam or post/column.

Additionally, applicant has provided a means for installing decorative inserts to the outside facing portions on the exterior of the beams and posts/columns to break-up the boredom of conventional bronze or white colored beams and posts/columns as is presently the case. These decorative inserts are available in a variety of colors which can be selected to match the window trim or interior decor of the pool/patio furnishings. In addition to a variety of colors, imitation wood grain, simulated stucco, and other surface finishes are also available. Thus, it can be seen that the subject invention provides almost limitless choices in outfitting one's screened enclosure.

DISCUSSION OF THE PRIOR ART

A search of the U.S. Patent Office files in the appropriate construction areas revealed the following patents:

U.S. Pat. No. 3,413,775—issued to Katz on Dec. 18, 1968 discloses a hollow building column 10 wherein tape members 22, 24 are utilized to secure substrates to the outer surface which have a decorative effect.

U.S. Pat. No. 3,745,734—issued to Davey et al on Jul. 17, 1983—discloses a joint structure for strip concealing members.

U.S. Pat. No. 5,904,022—issued to Zadak on May 18, 1999 discloses a post and beam construction which include grooves or recesses on the outer portions thereof for receiving cover members 16, 20, 22. The sole purpose of these covers is to improve the aesthetic appearance of the post and beam.

U.S. Pat. No. 3,416,282—issued to Daugherty on Dec. 17, 1968; U.S. Pat. No. 4,843,783—issued to Taravella on Jul. 4, 1988; and U.S. Pat. No. 5,088,253—issued to Autkeier on Feb. !8, 1992—These three patents disclose the use of trim strips which are received in grooves and used primarily for decorative purposes.

U.S. Pat. No. 5,203,130—issued to Freelove on Apr. 20, 1993

U.S. Pat. No. 5,737,878—issued o Rauleron et al on Apr. 14, 1998

U.S. Pat. No. 5,775,045—issued to Hill on Jul. 7, 1999—Each of these three patents disclose U-shaped members which are positioned over a door frame of jamb and serve as guards or shields to protect the frames against damage by wheelchairs, equipment and the like impacting upon them.

Although these patents disclose the use of decorative inserts on various building components including a post and beam, none disclose the use of U-shaped members which form a hollow beam wherein the inner walls of the beam or post/column receive metallic inserts to increase the structural strength thereof. Applicant's beam and post/column further includes means for receiving decorative inserts to improve their appearance. It is urged that none of the above cited patents taken alone or in combinations thereof are anticipatory of the claimed subject matter hereinafter.

SUMMARY OF THE INVENTION

From the foregoing discussion it can readily be seen that applicant has provided a unique beam and post/column design that allows one to create a beam and post/column that will be job specific and aesthetically pleasing to one's eyes. Once the calculations have been made as to the particular job site, the fabricator can readily determine the number of metallic inserts required to satisfy the structural load requirements. With this system, the inventory of beams and posts/columns required by the fabricator is reduced to a minimum since the structural requirements can readily be satisfied by the addition of one or more stock metallic inserts, up to a maximum of four to vary the load capacity.

Additionally, the subject invention provides for a wide selection of decorative inserts which can be readily installed without the need for special tools, clips or other hardware. After selection of the desired decorative style, one only needs to cut the vinyl or aluminum strip to its desired length and slide it into the channels, which are integrally formed on the exterior faces of the beam and post/column.

OBJECTS OF THE INVENTION

An object of the invention is to provide a patio/pool enclosure which utilizes unique beam and post/column components in its construction.

Another object of the invention is to provide a construction beam and post/column which includes means for varying its structural load capacity.

A further object of the invention is to provide a novel beam and post/column which reduces the inventory size required by a manufacturer.

Still another object of the invention is to provide a unique beam and post/column which can be incrementally strengthened through the selective addition of metallic inserts into the beam and post/column.

Yet another object of the invention is to provide a patio and pool enclosure which can be pre-assembled into panels for subsequent installation at the job site.

Another object of the invention is to provide a unique patio enclosure construction beam and post/column that includes integrally formed channels for receiving screening fabric and decorative inserts.

Yet another object of the invention is to provide a screened patio or patio/pool enclosure which becomes an integral outdoor extension of the home thus providing insect-free enjoyment to the homeowner.

These and other objects of the invention will become more apparent hereinafter. The instant invention will now be described with particular reference to the accompanying drawings that form a part of this specification wherein like reference characters designate the corresponding parts in the several views.

DETAILED DESCRIPTION OF THE DRAWINGS

Figure 1:
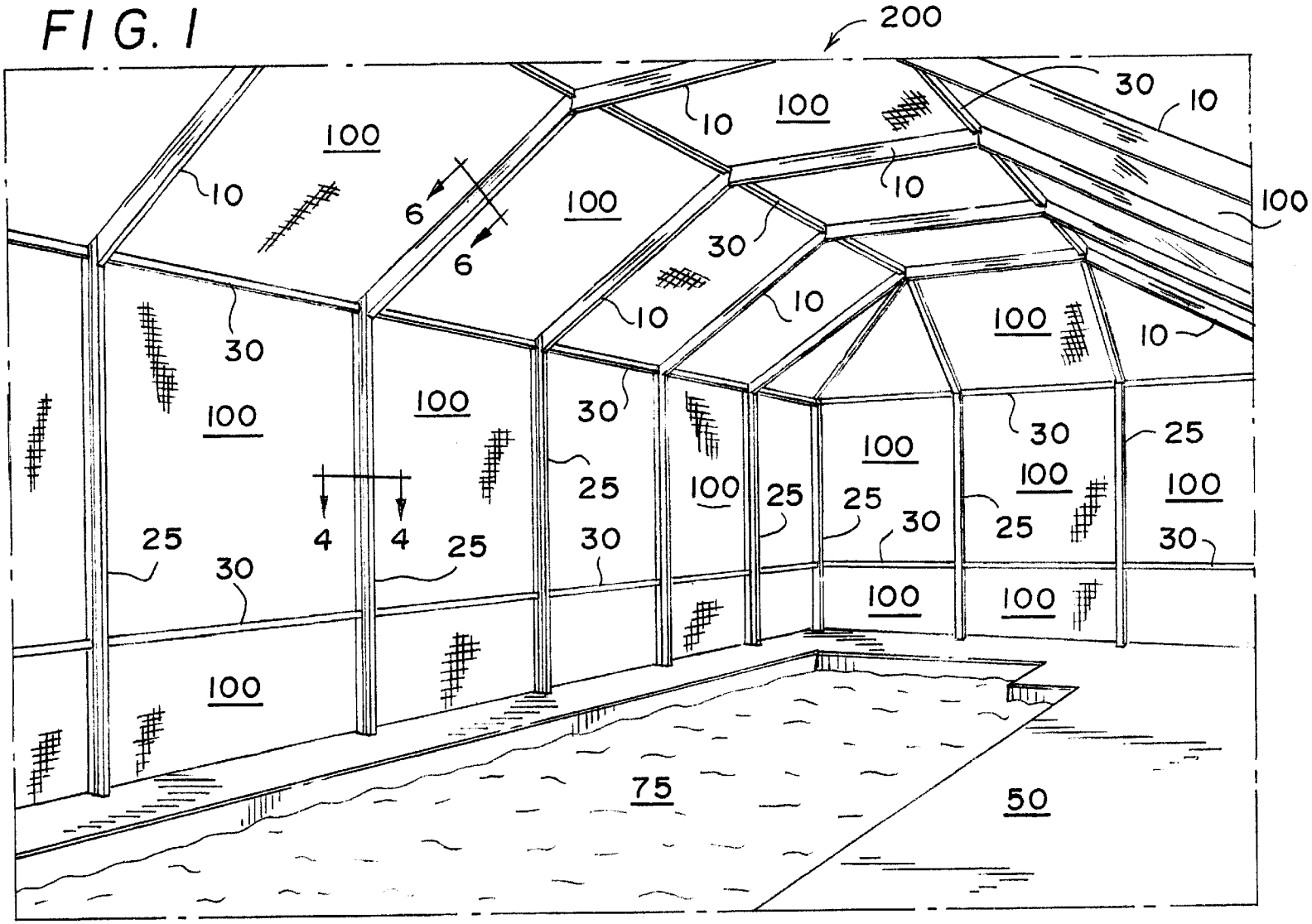
FIG. 1 is a perspective view of a screened patio and pool enclosure showing the novel beams and posts/columns in position for supporting the enclosure structure.

Referring to FIG. 1, there is illustrated a perspective view of a screened pool and patio enclosure 200 utilizing the novel beam and posts/column construction members of the subject invention to enclose a patio 50 and pool 75. There is shown a plurality of screening panels 100 which include fiberglass screening attached in the usual manner to the beams 10 and post/columns 25 with a plurality of purlins 30 interconnecting beams 10 and posts/columns 25 to provide stability and lateral support to the enclosure 200. Purlins 30 are commercially available aluminum components available in either hollow or solid form measuring approximately two inches by four inches to two inches by twelve inches in cross-section. As shown, beams 10 are the diagonal and horizontal upper structural members while the posts/columns 25 provide the vertical support to enclosure 200. The terms post/column refers to the vertical supports 25 which are sometimes referred to as "posts" and "columns". However, it is intended that the terms "posts" and "columns" are, in fact, the same component and can be used interchangeably.

Figure 2:
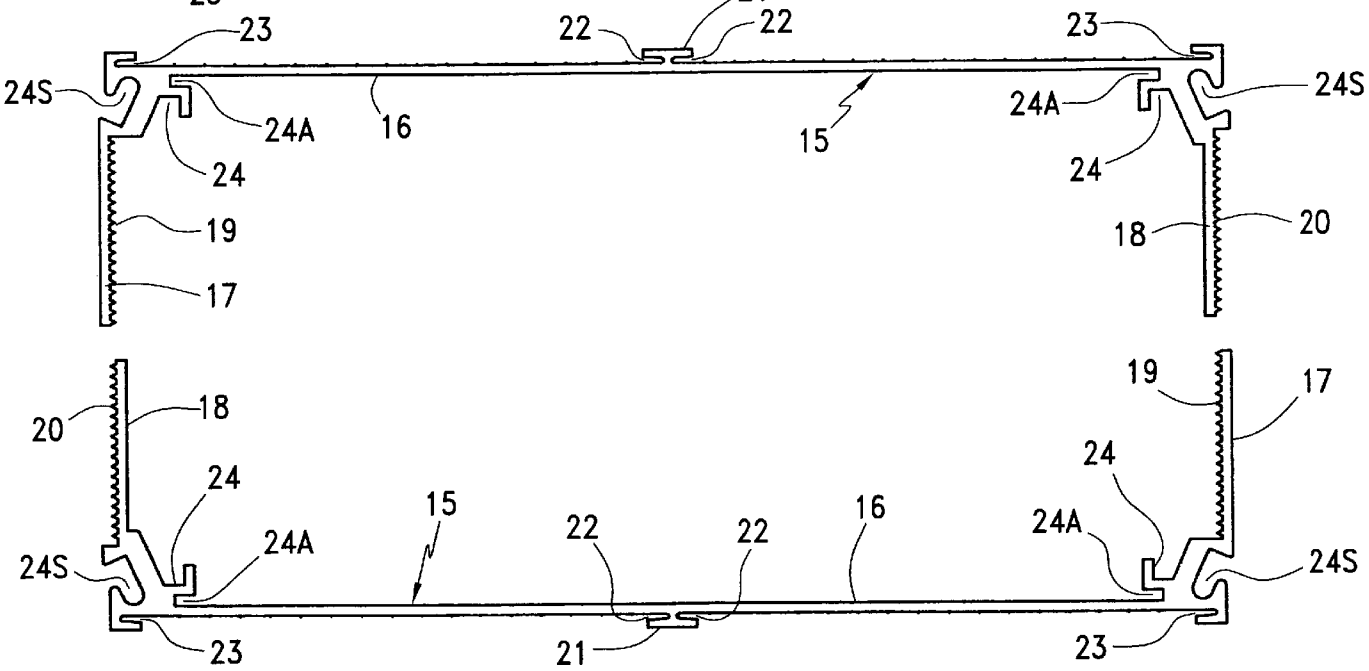
FIG. 2 is an illustration of a first embodiment of the novel U-shaped component used for the insertion of plural decorative and metallic inserts.

Turning now to FIG. 2, there is shown the two U-shaped components 15, which when united, form the hollow beams 10 and posts/columns 25. The beams 10 and posts/columns 25 are constructed of two U-shaped extruded aluminum components 15 which are identical to each other. In FIG. 2, the lower U-shaped component 15 is merely rotated 180 degrees relative to the upper U-shaped component 15. Each U-shaped component 15 comprises a horizontal mid-portion 16 with a pair of legs 17 and 18 extending downward from opposite ends thereof a short distance. Leg 17 is provided with inside ridges 19 while leg 18 has outer ridges 20 thereon. Centrally located on the outer surface of mid-portion 16 is divider 21. Divider 21 includes a pair of oppositely disposed recesses 22 which cooperate with recesses 23 on the opposite ends of mid-portion 16 to receive decorative inserts, not shown in this view. U-shaped components 15 also include two pair of oppositely disposed recesses 24, 24A at the inner corners thereof for receiving metallic inserts therein. Additionally, each U-shaped component 15 is provided with a pair of spline grooves 24S. Spline grooves 24S receive the screening fabric and is retained therein by a flexible vinyl or rubber-like retaining strip which is forced into spline grooves 24S over the screening fabric.

Figure 3:
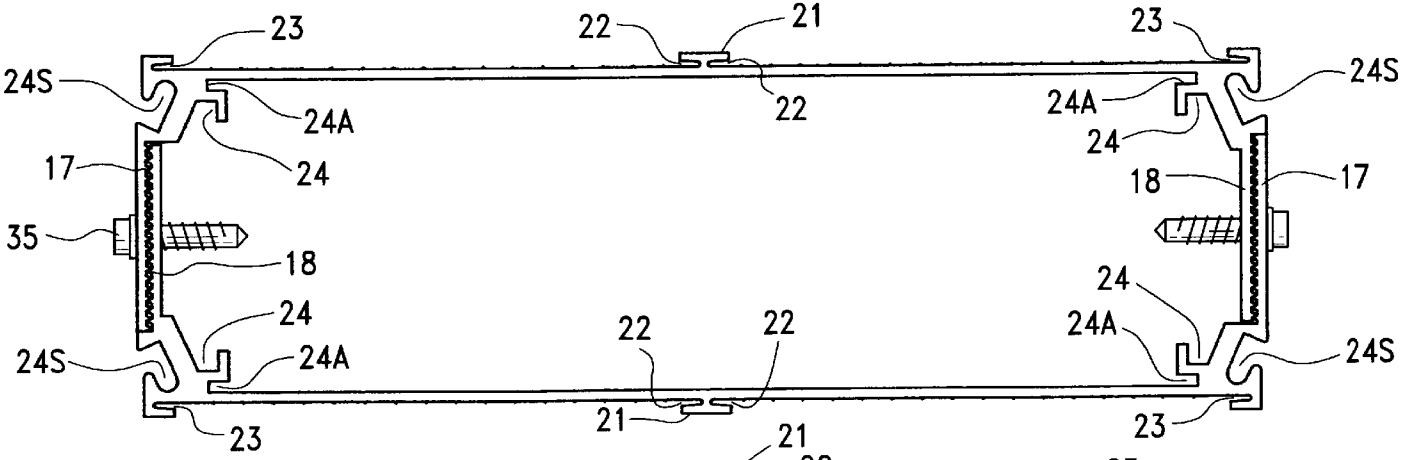
FIG. 3 illustrates the two U-shaped components joined together to form the hollow beam and post/column.

FIG. 3 illustrates the U-shaped members 15 of FIG. 2 in their mated condition, this is accomplished by merely sliding legs 17 and 18 of one U-shaped member 15 over legs 17 and 18 of the other U-shaped member 15, as shown, inner and outer ridges 19, 20 cooperate to securely hold U-shaped components 15 firmly together to form a hollow beam or post/column. A plurality of self-tapping screws 35 are inserted at spaced intervals from the outside through and into legs 17 and 18 to insure structural integrity of the unit.

Figure 4:
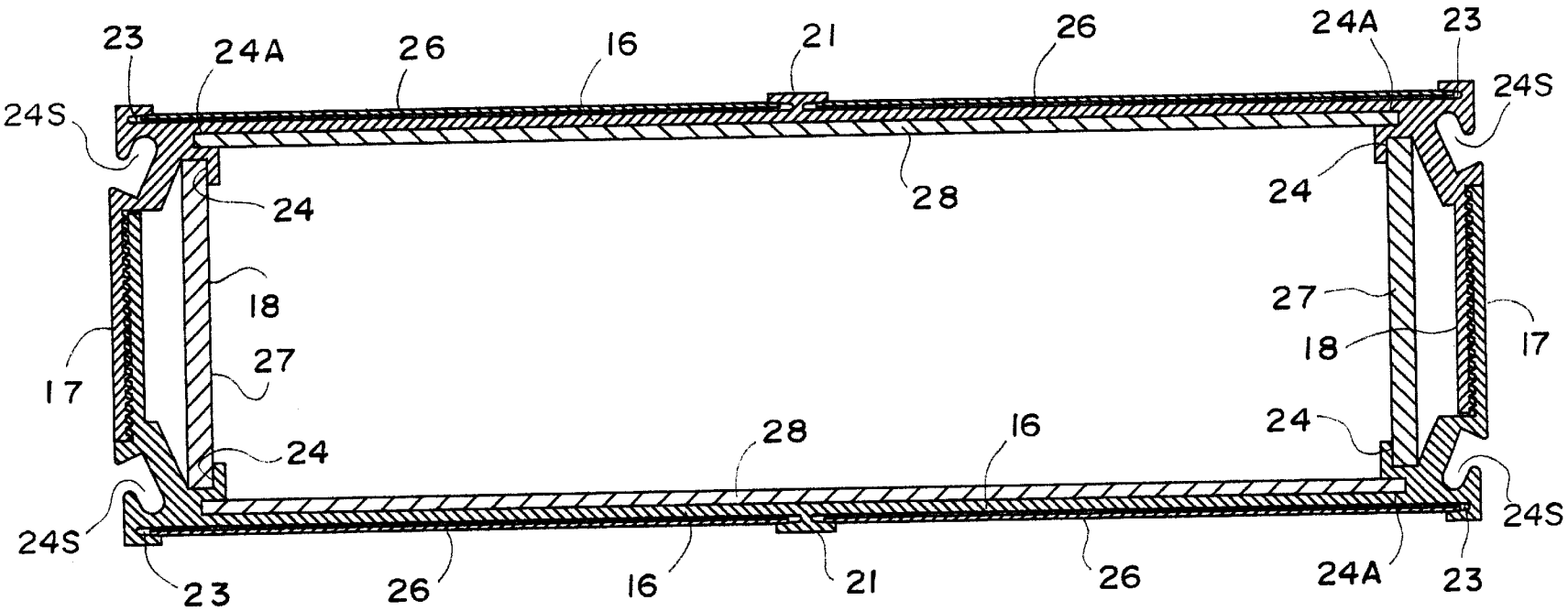
FIG. 4 is sectional view taken along the plane 4—4 of FIG. 1 illustrating the first embodiment of the novel beam and post/column with the metallic and decorative inserts placed therein.

Referring now to FIG. 4, there is shown a sectional view taken along the plane 4—4 of FIG. 1, illustrating a completed post/column 25 with a pair of decorative inserts 26 installed on each mid-portion 16. Additionally, metallic inserts 27 have been installed in recesses 24 with additional metallic inserts 28 installed in recesses 24A. Inserts 27 and 28 are made of aluminum bar stock material with inserts 27 shown thicker than inserts 28. The specific dimensions of these members may vary as required for a particular job.

Figure 5:
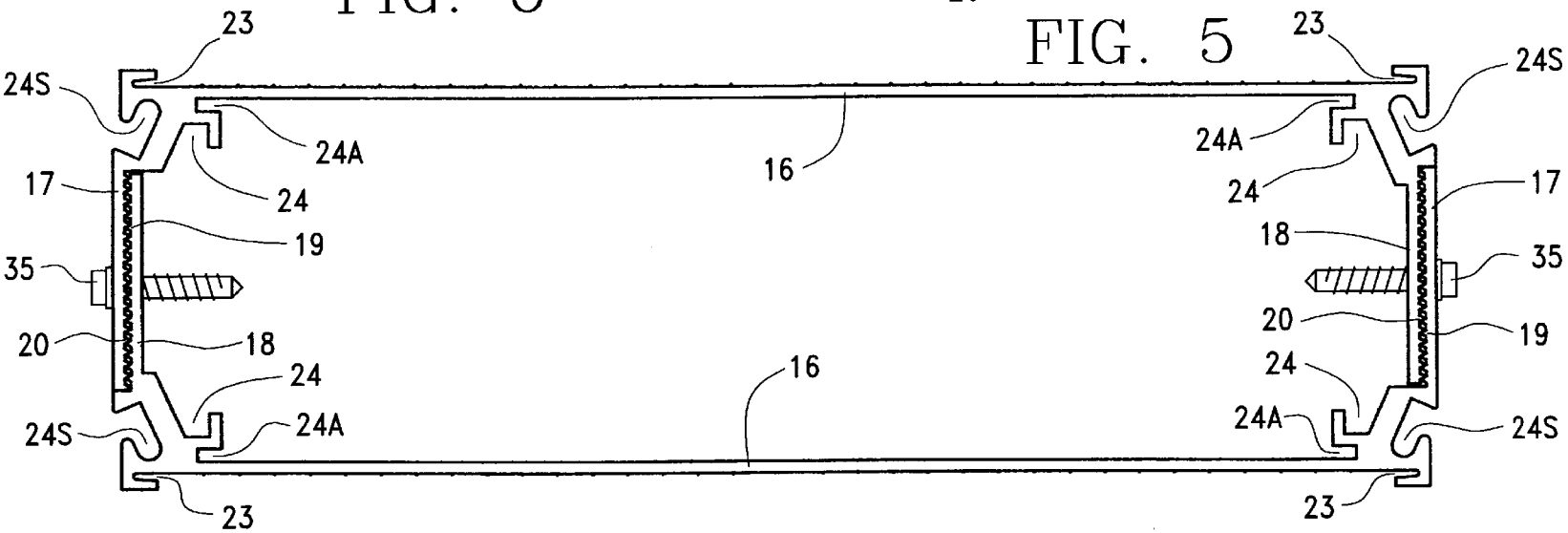
FIG. 5 illustrate the second embodiment of the novel U-shaped components joined together and illustrating their condition prior to insertion of any decorative or metallic reinforcement inserts therein.

Referring now to FIG. 5, there is shown another embodiment of the novel beam and post/column construction. This embodiment is identical to the first embodiment shown in FIG. 3, with one exception, divider 21 has been deleted. Without divider 21 a single decorative insert, extending the full width of mid-portion 16 can be inserted therein, thus giving the homeowner an additional choice as to whether a single or double decorative insert should be used.

Figure 6:
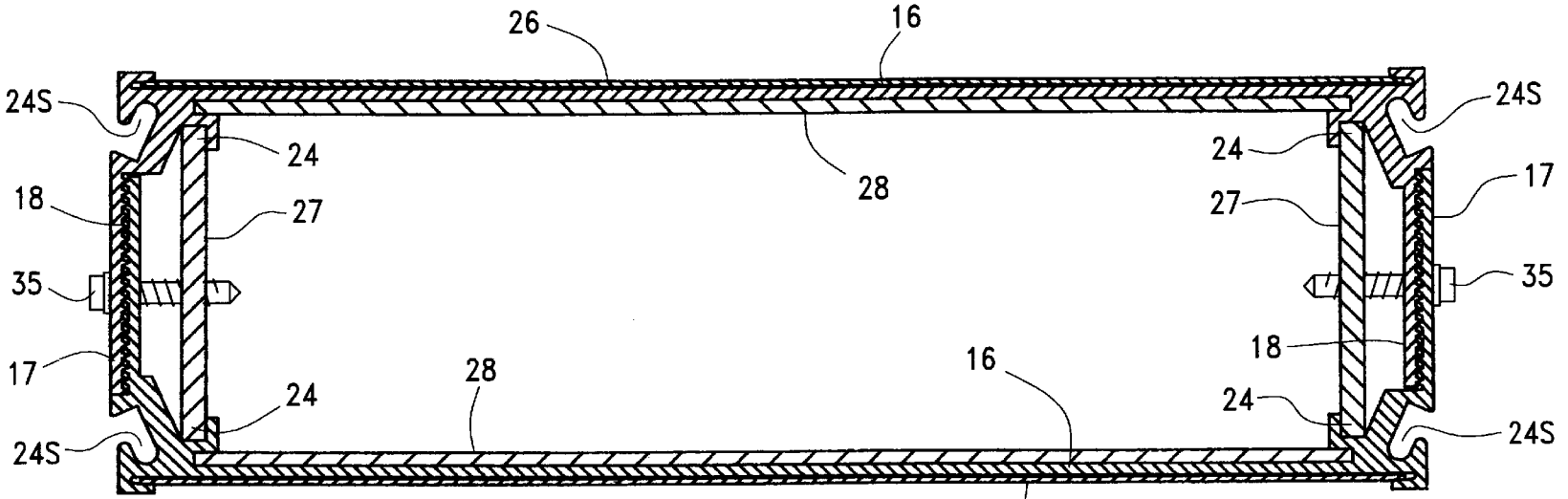
FIG. 6 illustrates a sectional view taken along the plane 6—6 of FIG. 1, illustrating the second embodiment wherein a single decorative insert is utilized on each outer face of the beam and post/column.

FIG. 6 is a sectional view taken along the plane 6—6 of FIG. 1, illustrating the assembled beam 10 with the four metallic inserts 27,27 and 28,28 inserted into their respective recesses for added structural strength. Additionally, a pair of decorative inserts have been placed in their respective recesses 23. The decorative variations of FIGS. 4 and 6 may be reversed or optionally, the decorative inserts of both the beam and post/column may be comprised of a single decorative insert 26 as in FIG. 6 or alternatively, both the beam and post/column may comprise plural decorative inserts as shown in FIG. 4.

Figure 7:
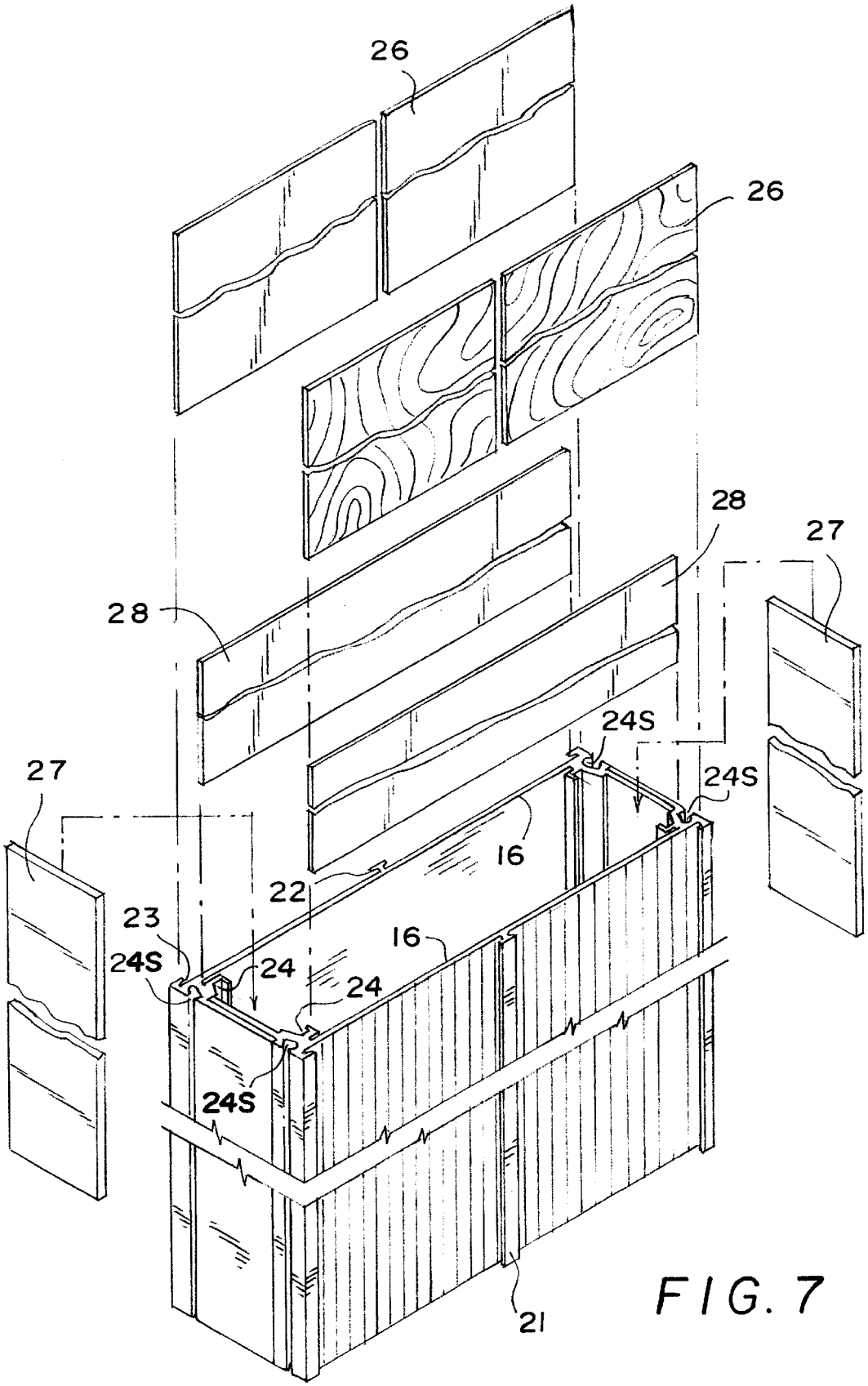
FIG. 7 is an exploded view of the unique beam and post/column illustrating the first embodiment and the manner of inserting the decorative and metallic inserts.

Turning now o FIG. 7, there is illustrated an exploded view of the FIG. 4 embodiment showing the metallic inserts 27,28 prior to insertion. Decorative inserts 26, with a simulated wood grain finish thereon are shown in alignment with recesses 24A about to be inserted therein. Additionally the metallic inserts are shown in their relative positions prior to insertion into their respective recesses.

By way of review, it is pointed out that applicant has provided a unique hollow beam and post/column construction that includes means for varying its structural load capacity by the insertion of additional load carrying members. As indicated earlier, these inserts are common aluminum flat bar stock material which are received in the interior of the beam and post/column. The number of inserts varies depending on the load requirements of the job. Additionally, applicant has provided a beam and post/column construction which is capable of receiving a variety of decorative inserts, thus adding to the interior beauty of the enclosure.

While the invention has been described in its preferred embodiments, it is to be understood that the words used herein are words of description rather than words of limitation and that changes may be made within the purview of the appended claims without departing from the full scope or spirit of the invention.

Having thus described my invention, I claim:

1. A hollow beam and column/post construction component comprising:

a pair of unitary elongate U-shaped members, each having a centrally located mid-portion with a pair of depending legs extending from opposite ends thereof;

said centrally located mid-portion having a divider with oppositely disposed recesses for receiving decorative inserts therein;

said depending legs integrally formed and extending in the same direction for a distance less than the length of said mid-portion;

insert receiving means located at the interior and exterior corner portions of said U-shaped member;

strengthening means received in said interior insert receiving means;

screening retaining means comprised of channels on said depending legs for retaining screening therein;

decorative means received in said exterior insert receiving means and said oppositely disposed recesses of said divider whereby the load capacity of U-shaped members can he varied to meet different load requirements and the aesthetic appearance of said hollow beam and column/post can he changed as desired.

2. A hollow beam and column/post construction component as defined in claim 1 wherein said depending legs include retaining means that are disposed on opposite surfaces of the respective legs.

3. A hollow beam and column/post construction component as defined in claim 2 wherein said retaining means comprises a plurality of spaced ridges on said depending legs and a plurality of self-tapping fasteners inserted through said depending legs to provide additional strength and rigidity to said hollow beam and column/post.

4. A hollow beam and column/post construction component as defined in claim 3 wherein said spaced ridges of one beam component cooperate with the spaced ridges of a second beam component to interlock and retain said beam components together to form said hollow beam.

5. A hollow beam and column/post construction as defined in claim 1 wherein said unitary elongate U-shaped member comprises an extruded aluminum profile member.

6. A hollow beam and column/post construction component as defined in claim 1 wherein said interior insert retaining means comprises a pair of recesses disposed at opposite ends of said mid-portion for receiving said strengthening means therein.

7. A hollow beam and column/post construction component as defined in claim 6 wherein said strengthening means comprises elongate metallic inserts that are received in said interior insert receiving recesses.

8. A hollow beam and column/post construction component as defined in claim 1 wherein said decorative insert comprises an elongate vinyl trim strip of a particular color and pattern.

9. A hollow beam and column/post construction component as defined in claim 1 wherein said decorative insert comprises an elongate aluminum trim strip of a particular color and pattern.

* * * * *